US007475501B1

(12) United States Patent
DeToro et al.

(10) Patent No.: US 7,475,501 B1
(45) Date of Patent: Jan. 13, 2009

(54) PROTECTIVE, REMOVABLE BOOT FOR A BRACE, CAST OR ORTHOTIC DEVICE

(75) Inventors: William W. DeToro, Poland, OH (US); Brian S. Perala, Poland, OH (US); William A. DeToro, Poland, OH (US)

(73) Assignee: Anatomical Concepts, Inc., Poland, OH (US)

( * ) Notice: Subject to any disclaimer, the term of this patent is extended or adjusted under 35 U.S.C. 154(b) by 367 days.

(21) Appl. No.: 11/492,619

(22) Filed: Jul. 25, 2006

(51) Int. Cl.
*A43B 1/02* (2006.01)

(52) U.S. Cl. ..... 36/110; 36/9 R

(58) Field of Classification Search ..... 36/110, 36/9 R, 77 R, 7.1 R
See application file for complete search history.

(56) References Cited

U.S. PATENT DOCUMENTS

| | | | | | |
|---|---|---|---|---|---|
| 3,735,758 | A | | 5/1973 | Novotney | |
| 3,905,135 | A | | 9/1975 | Debusk | |
| 4,178,703 | A | * | 12/1979 | Pols | 36/110 |
| D255,954 | S | | 7/1980 | Foote | |
| 4,265,033 | A | | 5/1981 | Pols | |
| 4,301,603 | A | | 11/1981 | Scott | |
| 4,899,468 | A | * | 2/1990 | Richbourg et al. | 36/110 |
| 5,088,481 | A | | 2/1992 | Darby | |
| 5,600,901 | A | * | 2/1997 | Leonor | 36/7.1 R |
| 5,699,629 | A | * | 12/1997 | Munschy | 36/97 |
| 5,778,565 | A | * | 7/1998 | Holt et al. | 36/110 |
| 5,890,302 | A | * | 4/1999 | Kirkis | 36/138 |
| 5,940,992 | A | * | 8/1999 | Darby | 36/110 |
| 6,272,771 | B1 | * | 8/2001 | Rodi | 36/77 R |
| 6,427,363 | B1 | * | 8/2002 | Hunter | 36/100 |
| 2003/0196352 | A1 | * | 10/2003 | Bledsoe et al. | 36/110 |
| 2005/0172517 | A1 | * | 8/2005 | Bledsoe et al. | 36/110 |
| 2005/0274046 | A1 | * | 12/2005 | Schwartz | 36/110 |

* cited by examiner

*Primary Examiner*—Marie Patterson
(74) *Attorney, Agent, or Firm*—Robert J. Herberger

(57) ABSTRACT

A removable boot/protector for a foot or ankle that has been placed in a brace, cast or orthotic device comprising of a flexible, substantially weather-resistant body portion having a an inner sole; an enclosed toe section that extends upwardly from a front end of said inner sole and terminates in a first toe fastening means; a pair of side sections each of which extend upwardly from said inner sole and terminate in a flap that extends from the toe section, upwardly along an upper arch region of the foot and toward a front region of the ankle, each of said side section flaps connecting together at least partially along said upper arch region; and an enclosed heel section that extends upwardly from a rear end of said inner sole, said inner sole, toe, heel and side sections defining a cavity into which the human foot may be inserted and removed.

18 Claims, 4 Drawing Sheets

PROTECTIVE, REMOVABLE BOOT FOR A BRACE, CAST OR ORTHOTIC DEVICE

BACKGROUND OF THE INVENTION

1. Field of the Invention

The present invention relates to boots and/or weather protectors for a human foot or ankle in a brace, cast or orthotic device. This invention further relates to a removable boot/protective cover through which the foot in a brace, cast or orthotic device can be inspected, treated and/or managed as medically necessary.

2. Description of Related Art

Several devices are known for protecting a human foot that has been placed in a cast. In a primitive sense, a casted foot was protected by the boot of Debusk U.S. Pat. No. 3,905,135 with its shock-absorbent heel cushion 16. Later models took into account a double rocker bottom like the dual pivot point, medical boot of Darby U.S. Pat. No. 5,088,481. But, neither of these boot models could ever be mistaken for providing substantially waterproof/soil resistant protection to its wearer.

An alternative to the boot idea was set forth in the cast shoe of Pols U.S. Pat. No. 4,265,033. For a total resistance to the elements, Scott U.S. Pat. No. 4,301,603 disclosed a one-piece shell made of resilient foam. While designed to flex or stretch over the foot of its wearer, it could pose serious difficulties fitting over a variety of today's castless, foot or ankle brace alternatives. Even more boot-like was the cast configuration by Foote U.S. Design Pat. No. 255,954.

Most recently, a "convertible" variation was disclosed in Holt et al U.S. Pat. No. 5,778,565. When needed, that footgear could be fitted with an otherwise removable toe piece.

Finally, there is the foot and ankle cast enclosure of Novotney U.S. Pat. No. 3,735,758. With its vertically disposed rear seam 24, this enclosure is meant for its wearer to step into before its front straps 34 are secured to the front ankle region. Then, an integrally formed, tongue cover 22 is flipped up and, itself, strapped laterally around the wearer's whole ankle/foot for reconnecting rearward.

None of the foregoing boots provide adequate protection from the elements, even on a temporary basis, such as when having to commute from vehicle to a business or home, while still allowing for some adjustment access to the brace or orthosis device of a wearer/patient. Representative orthotic devices are depicted in DeToro U.S. Pat. Nos. 6,377,178, 6,350,246, 6,302,858, 5,944,679, 5,908,398, 5,593,383, 5,545,127 and 5,088,479. It is to be understood, however, that the invention will also adequately install over and protect the wearers of casts and/or other foot and ankle orthotic devices.

A genuine need exists for an improved cast or orthotic device/brace boot or protector through which the wearer's foot, particularly the heel region, can be inspected or examined for not only unwanted contact but to help insure the orthotic device has been properly fitted. Depending on that examination, a professional could make adjustments through this boot to the posterior upright element of said orthotic device. Should there be a need to run electrical connectors to a patient's heel for a monitoring device, a boot/protector like this should allow for the temporary use of electrical lead access.

SUMMARY OF THE INVENTION

It is an object of the present invention to provide a removable boot for a foot or ankle in a brace, cast or orthotic device. That boot/protector comprises a flexible, substantially weather-resistant body portion having an inner sole that is preferably non-skid; an enclosed toe section that extends upwardly from the front end of that inner sole before terminating in toe fastening means. Two side sections extend upwardly from that same inner sole, each side section terminating in a flap that extends from the toe, along the upper arch region of the wearer's foot and toward the front of the wearer's ankle. Each side section flap connects at least partially along the wearer's upper arch region. At the rear of this boot, an enclosed heel section extends upwardly from the inner sole. Preferably, that heel section includes an aperture through which the pivot joint of an orthosis device may at least partially protrude for inspection and potential servicing. On the boot bottom, it is most preferred that a non-skid outer sole be affixed.

It is a main object to provide the wearers of various orthotic devices with water-resistant or weatherproof means for protecting feet from the elements while still in their medical devices. It is another object to provide adjustable water- and/or soil-resistant coverage about the wearer of a foot brace and/or cast. Yet another object is to include with these boots/protectors at least some limited ability to inspect and adjust (or otherwise service) the orthotic device while the boot stays on.

Other objects and features of the present invention will be obvious to those of skill in the art. It should be noted, however, that the drawings are designed for the purpose of illustration only and not as a definition of the limits of the instant invention, for which reference should be made to the claims appended hereto.

BRIEF DESCRIPTION OF THE DRAWINGS

Further features, objectives and advantages of the present invention will become clearer when referring to the following detailed description of preferred embodiments made with reference to the accompanying drawings in which.

DETAILED DESCRIPTION OF PREFERRED EMBODIMENTS

Referring now to FIGS. 1 through 7, there is shown one preferred embodiment of the invention. The boot, generally 10, is meant for a human foot or ankle to be easily, yet repeatedly inserted into same, with little effort. More particularly, this boot 10 fits about the foot or ankle being medically treated with a brace or orthosis device (not shown). To a lesser degree, this invention provides an alternative boot configuration for someone wearing a cast about their lower foot or ankle.

The main component of boot is its weather resistant, outer body portion 12. One material suitable for its manufacture is vinyl. Alternatively, other materials suitable for use in the construction of such boots are Naugahyde®, Gore-tex® or other waterproof materials. Should an upscale model be preferred, body portion 12 can be made of leather.

Figure 1:
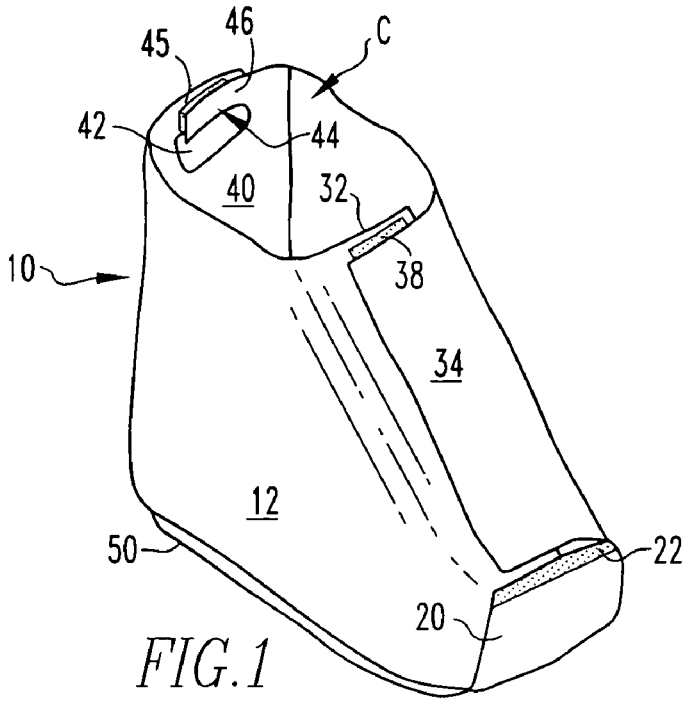
FIG. 1 is an elevated perspective view of the present invention as it would be installed about a patient's foot (not shown)
Figure 2:
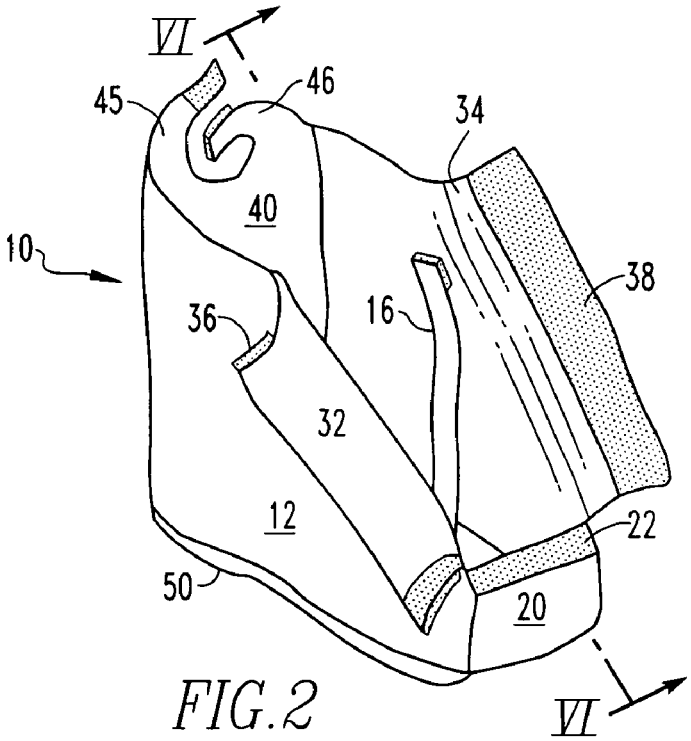
FIG. 2 is an elevated perspective view of the present invention in an open, or to-be-installed, position.
Figure 3:
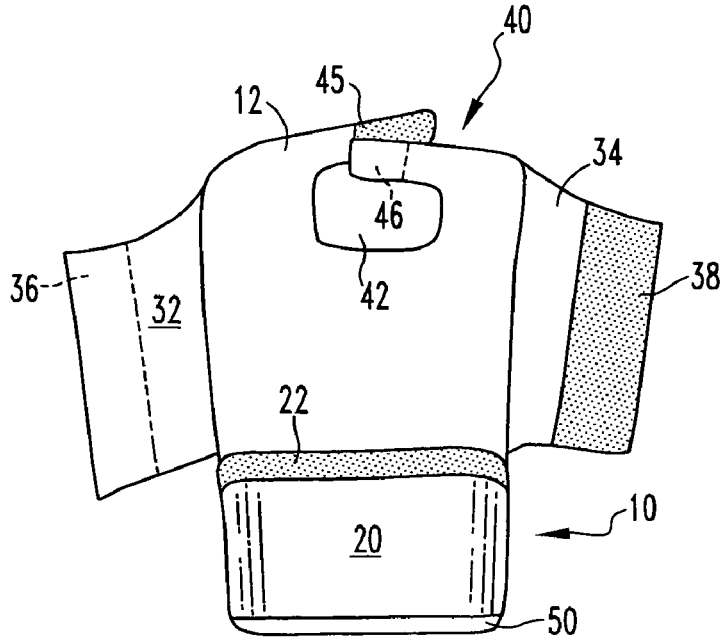
FIG. 3 is a front elevational view of the open boot of FIG 2.
Figure 4:
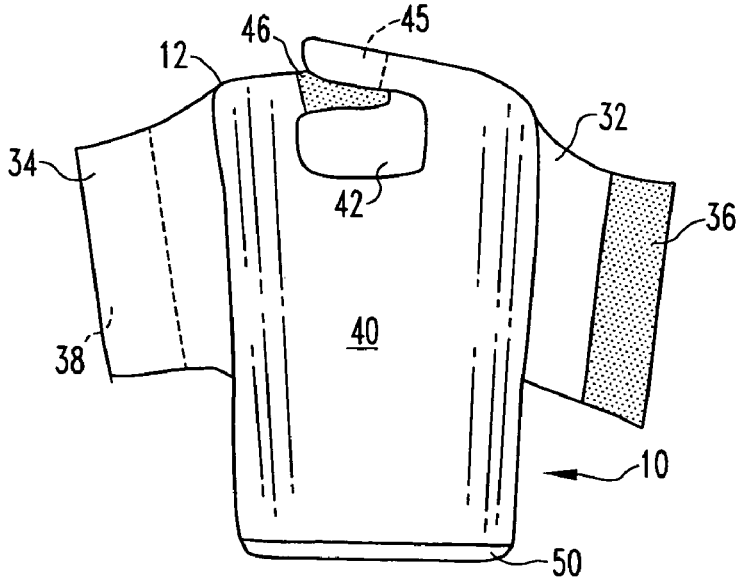
FIG. 4 is a rear elevational view of the same open boot of the present invention.
Figure 5:
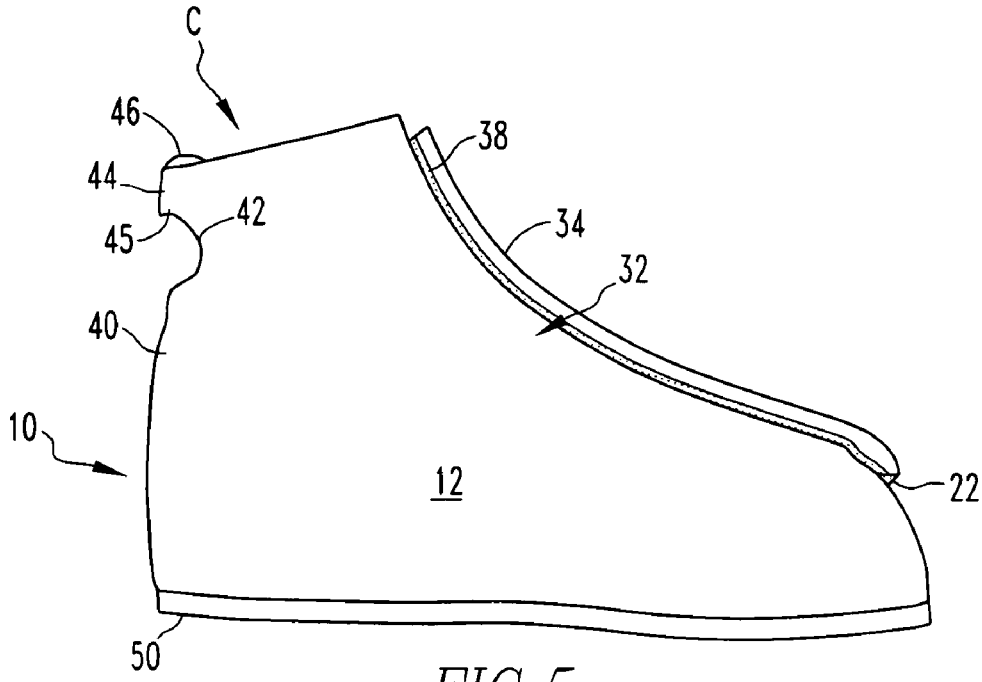
FIG. 5 is a side elevational view of the left side to the FIG. 1 boot.
Figure 6:
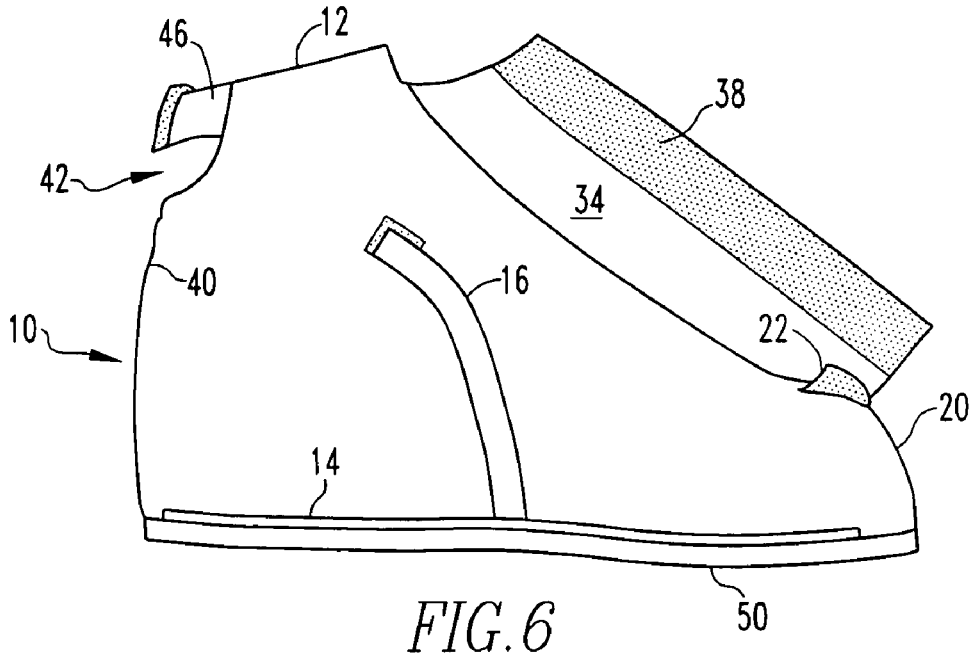
FIG. 6 is a cross-sectional view taken along lines VI-VI of FIG. 2.

As best seen in FIG. 6, the base to body portion 12 is provided with an inner sole 14. One suitable material for making same is rubber-based, or alternatively from a high friction coefficient material, e.g. crepe, tack cloth, or similar high friction material that would render the boot interior substantially non-skid. With such an inner sole on which to walk, the boot of this invention is able to accommodate various ankle/foot treating, devices, i.e, those having a flat outer sole as well as those having a lower rocker bottom design. The inner sole 14 to boot 10 prevents multi-planner shearing of the foot/ankle complex during ambulation. Optionally, an adjustable inner strap 16 (made of elastic, hook & loop Velcro® and/or similar materials) can be used to prevent pistoning of the foot/ankle complex along with other migrational forces from occurring. Inner sole 14 can be adhesively bonded to the base of boot 10 or partially stitched into same.

Extending upwards from a front end of inner sole 14 is an enclosed toe section 20. Though shown as a substantially squared off, it is to be understood that other sole and toe section shapes can be accommodated hereby. A squared off, front toe shape allows for more universal application in that the same model of boot can be used on either the wearer's left or right foot.

At an uppermost edge of toe section 20, there is a first toe fastening means 22. Preferably, this first toe fastener is made of a Velcro® strip to which a complementary section is attached. In one embodiment, that matching Velcro® strip is sewn to one of the two flaps to the adjoining side sections. Alternately, both side section flaps can include a lower, second toe fastening means (corresponding Velcro® strip) for each to connect at least partially with toe section 20. Should the use of Velcro® fastening for toe section 20 not be preferred, one or more snaps, eyelets or other known fastening combinations may be used in combination with or in lieu of same.

Extending upward from each side of inner sole 14 are side sections 30. Each side section terminates in a flap, with left flap 32 and right flap 34 preferably designed to at least partially overlap with one another. Both flaps 32 and 34 extend along an upper arch region of the wearer's foot toward their front ankle region. Both flaps include flap connecting means for providing a more environmentally resistant, sound seal about the wearer's foot. As shown, left flap 32 includes a strip of Velcro® loop/hook 36 along its outermost lip and extending along substantially its full length, from near toe section 20 to the region of flap 32 closest to the wearer's ankle. A corresponding, complementary strip of Velcro® pile 38 extends along the interior of right flap 34 for easily joining together with little to no applied pressure to best secure this boot about the wearer on repeat occasions.

Like the toe fastening means 22, alternative snap, eyelet, even freezer bag, zipper-like seals can be used to either supplement, or fully replace the aforementioned Velcro® strips, flap connecting means 36 and 38. It is preferred, however, that any such connecting means be easily connected and disconnected without requiring any third party assistance.

Rearward of the side sections, boot 10 further includes a heel section 40. Together with toe section 20 and both side sections 30, heel section defines a cavity C into which the foot of a patient wearing a brace or orthosis device, even a full or partial cast, can be repeatedly inserted and removed. Preferably, body portion 12 of boot 10 is integrally formed.

Figure 7:
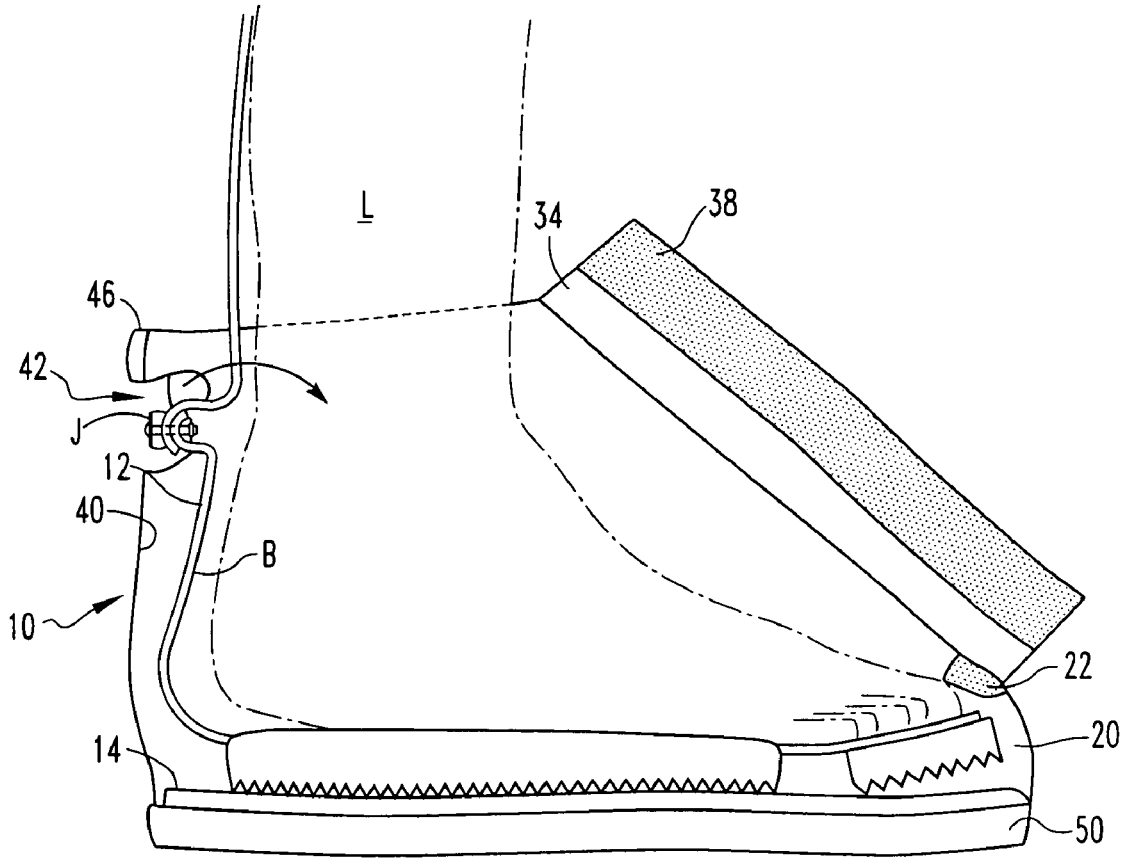
FIG. 7 is a cross-sectional view of the FIG. 6 boot in which a patient's foot in an orthotic brace has been placed for illustration purposes.

To better accommodate the pivot joint of a typical orthosis device, heel section 40 of boot 10 includes an upper aperture 42. As shown, that aperture forms with the joining of two upper heel fastening straps 44 (with a left strap 45 and right strap 46), each with a complementary section of Velcro® tape affixed to same. In the alternative, other snap, rivet, belt and/or buckle means may be used in place of upper heel fastening straps 44. To a lesser degree, a permanently affixed section of elastic may be used. With the proper degree of elasticity, such a section could hold heel section 40 in place while still allowing for some stretching over the pivot joint of an orthosis device when the boot is installed and removed from the wearer/patient. In FIG. 7, a patient's leg L in an orthotic brace B is included. Note the placement of pivot joint J on that brace B. With the present invention, a professional can service and adjust the relative position of that pivot joint J through upper aperture 42.

As seen in FIGS. 3 through 7, a non-skid, rubber outer sole 50 is affixed to the bottom of boot 10. In essence, inner sole 14 and outer sole 50 sandwich the base of boot 10. They can be attached adhesively, and/or at least partially stitched together.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A removable boot for a human foot or ankle which is adapted for fitting about the foot in an orthotic device such as a brace or cast, said boot comprising a flexible, substantially weather-resistant body portion having:

(a) an inner sole;

(b) an enclosed toe section that extends upwardly from a front end of said inner sole and terminates in a first toe fastening means;

(c) a pair of side sections each of which extend upwardly from sides of said inner sole and terminate in a flap that extends from the toe section, upwardly along an upper arch region of the foot and toward a front region of the ankle, each of said side section flaps connecting together at least partially along said upper arch region; and (d) an enclosed heel section that extends upwardly from a rear end of said inner sole, said heel section includes an aperture through which a pivot joint of the brace or cast may partially protrude, and said inner sole, toe, heel and side sections defining a cavity into which the human foot may be inserted and removed.

2. The brace or cast boot of claim 1 which further includes a non-skid outer sole.

3. The brace or cast boot of claim 1, wherein said inner sole, toe, heel and side sections are integrally formed.

4. The brace or cast boot of claim 1, wherein said toe, heel and side sections are made from a vinyl material.

5. The brace or cast boot of claim 1, wherein said toe, heel and side sections are made from leather.

6. The brace or cast boot of claim 1, wherein at least one of said side sections overlaps said toe section and includes a second toe fastening means.

7. The brace or cast boot of claim 6, wherein said first and second toe fastening means include complementary hook and loop fasteners.

8. The brace or cast boot of claim 1, wherein one of said side sections substantially overlaps the other side section after the foot is inserted and each side section includes upper arch fastening means.

9. The brace or cast boot of claim 8, wherein said upper arch fastening means include complementary hook and loop fasteners.

10. The brace or cast boot of claim 1, wherein said heel section includes an upper heel fastening means for adjusting about the pivot joint of the orthotic device.

11. The brace or cast boot of claim 1, wherein said upper heel fastening means include complementary hook and loop fasteners.

12. A boot for protecting the wearer of a foot orthotic device, said boot comprising a flexible, substantially weather-resistant body portion having:

(a) an inner sole;

(b) an enclosed toe section that extends upwardly from a front end of said inner sole and terminates in toe fastening means;

(c) a pair of side sections each of which extend upwardly from sides of said inner sole and terminate in a flap that extends from the toe section, upwardly along an upper arch region of the foot and toward a front region of the ankle, one of said side section flaps overlapping the toe fastening means, and one of said side section flaps overlapping the other side section flap and connecting at least partially along said upper arch region;

(d) an enclosed heel section that extends upwardly from a rear end of said inner sole, said heel section including an aperture through which a pivot joint of the orthotic device may partially protrude, said inner sole, toe, heel and side sections defining a cavity into which the orthotic device wearer may insert and remove his or her foot; and (e) a non-skid outer sole.

13. The orthotic device boot of claim 12, wherein said heel section includes upper heel fastening means for adjusting about the pivot joint.

14. The orthotic device boot of claim 13, wherein said upper heel fastening means include complementary hook and loop fasteners.

15. The orthotic device boot of claim 12, wherein said inner sole is non-skid.

16. The orthotic device boot of claim 12, wherein said inner sole, toe, heel and side sections are integrally formed.

17. The orthotic device boot of claim 12, wherein said toe, heel and side sections are made from a vinyl material.

18. The orthotic device boot of claim 12, wherein a first side section flap overlaps the toe fastening means of the toe section and a second side section flap overlaps the first side section flap, each side section flap including either of hook and loop complementary fasteners.

* * * * *